US008206100B2

(12) United States Patent
Schuler et al.

(10) Patent No.: US 8,206,100 B2
(45) Date of Patent: Jun. 26, 2012

(54) STATOR ASSEMBLY FOR A GAS TURBINE ENGINE

(75) Inventors: Arthur Schuler, Fairfield, OH (US); Marek Szrajer, Warsaw (PL); Leszek Rzeszutek, Warsaw (PL); Jakub Broniszewski, Bartoszyce (PL)

(73) Assignee: General Electric Company, Schenectady, NY (US)

( * ) Notice: Subject to any disclaimer, the term of this patent is extended or adjusted under 35 U.S.C. 154(b) by 788 days.

(21) Appl. No.: 12/347,402

(22) Filed: Dec. 31, 2008

(65) Prior Publication Data

US 2010/0166545 A1 Jul. 1, 2010

(51) Int. Cl.
*F03B 1/00* (2006.01)

(52) U.S. Cl. ..... 415/209.4; 415/189; 415/119

(58) Field of Classification Search ..... 415/209.3, 415/209.4, 189, 119, 210.1, 190
See application file for complete search history.

(56) References Cited

U.S. PATENT DOCUMENTS 6,595,747 B2 * 7/2003 Bos ..... 415/209.4

* cited by examiner

*Primary Examiner* — Ross Gushi
(74) *Attorney, Agent, or Firm* — David J. Clement; Trego, Hines & Ladenheim, PLLC

(57) ABSTRACT

A stator assembly for a gas turbine engine includes: (a) an outer shroud having a circumferential array of outer slots; (b) an inner shroud having a circumferential array of inner slots; (c) a plurality of airfoil-shaped vanes extending between the inner and outer shrouds, each vane having inner and outer ends which are received in the inner and outer slots; and (d) an annular, resilient retention ring spring which engages the inner ends of the vanes and urges them in a radially inward direction.

17 Claims, 5 Drawing Sheets

STATOR ASSEMBLY FOR A GAS TURBINE ENGINE

BACKGROUND OF THE INVENTION

This invention relates generally to gas turbine engines and more particularly to stationary aerodynamic members of such engines.

Gas turbine engines include one or more rows of stationary airfoils referred to as stators or vanes, which are as used to turn airflow to a downstream stage of rotating airfoils referred to as blades or buckets. Stators must withstand significant aerodynamic loads, and also provide significant damping to endure potential vibrations.

Particularly in small scale stator assemblies, the airfoils plus their surrounding support members are typically manufactured as an integral machined casting or a machined forging. Stators have also been fabricated by welding or brazing. Neither of these configurations are conducive to ease of individual airfoil replacement or repair.

Other stator configurations (e.g. mechanical assemblies) are known which allow easy disassembly. However, these configurations lack features that enhance the rigidity of the assembly while maintaining significant damping.

BRIEF SUMMARY OF THE INVENTION

These and other shortcomings of the prior art are addressed by the present invention, which provides a stator assembly that is rigid and well-damped in operation which can be readily disassembled to facilitate repair or replacement of individual components.

According to one aspect, a stator assembly for a gas turbine engine includes: (a) an outer shroud having a circumferential array of outer slots; (b) an inner shroud having a circumferential array of inner slots; (c) a plurality of airfoil-shaped vanes extending between the inner and outer shrouds, each vane having inner and outer ends which are received in the inner and outer slots; and (d) an annular, resilient retention ring spring which engages the inner ends of the vanes and urges them in a radially inward direction.

According to another aspect of the invention, a method of assembling a stator assembly for a gas turbine engine includes: (a) providing an outer shroud having a circumferential array of outer slots; (b) providing an inner shroud having a circumferential array of inner slots; (c) inserting a plurality of airfoil-shaped vanes through the inner and outer slots; and (d) engaging the inner ends of the vanes with a resilient retention ring which urges them in a radially inward direction.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
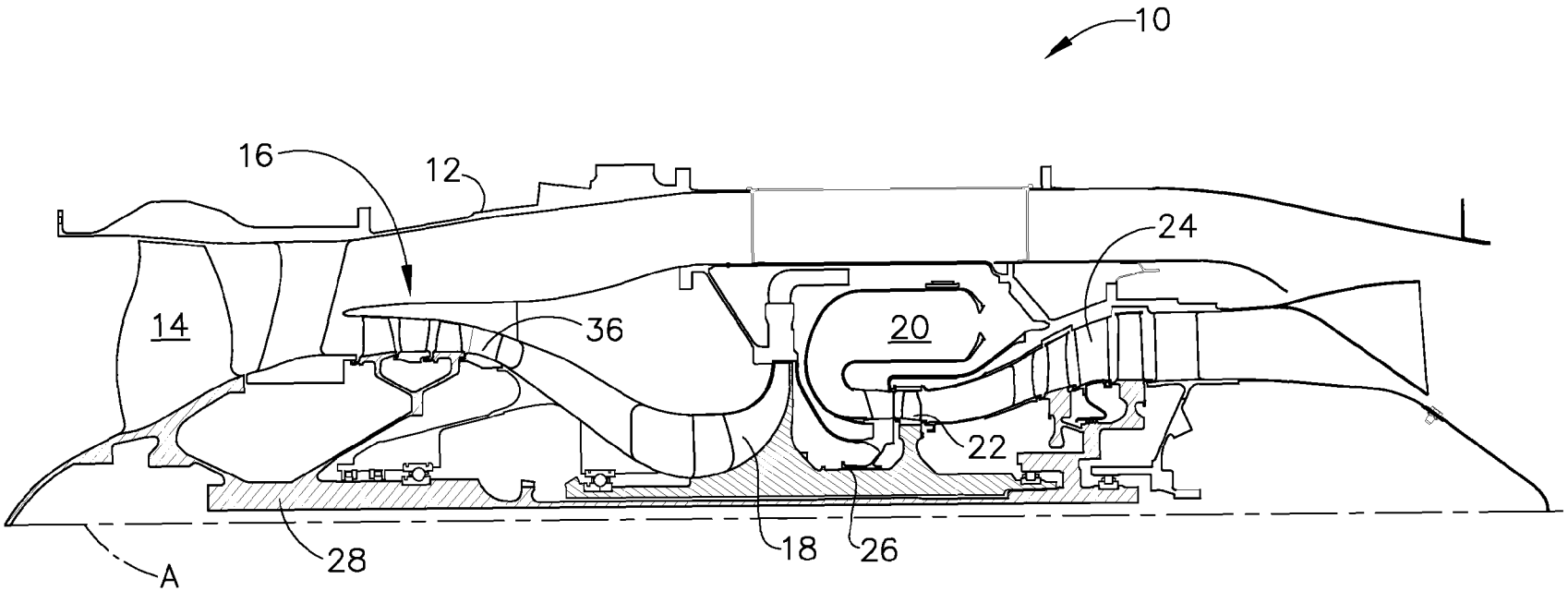
FIG. 1 a schematic half-sectional view of a gas turbine engine incorporating a stator assembly constructed in accordance with an aspect of the present invention.

Referring to the drawings wherein identical reference numerals denote the same elements throughout the various views, FIG. 1 illustrates a representative gas turbine engine, generally designated 10. The engine 10 has a longitudinal center line or axis A and an outer stationary annular casing 12 disposed concentrically about and coaxially along the axis A. The engine 10 has a fan 14, booster 16, compressor 18, combustor 20, high pressure turbine 22, and low pressure turbine 24 arranged in serial flow relationship. In operation, pressurized air from the compressor 18 is mixed with fuel in the combustor 20 and ignited, thereby generating combustion gases. Some work is extracted from these gases by the high pressure turbine 22 which drives the compressor 18 via an outer shaft 26. The combustion gases then flow into a low pressure turbine 24, which drives the fan 14 and booster 16 via an inner shaft 28. The fan 14 provides the majority of the thrust produced by the engine 10, while the booster 16 is used to supercharge the air entering the compressor 18. The inner and outer shafts 28 and 26 are rotatably mounted in bearings which are themselves mounted in one or more structural frames, in a known manner.

In the illustrated example, the engine is a turbofan engine. However, the principles described herein are equally applicable to turboprop, turbojet, and turbofan engines, as well as turbine engines used for other vehicles or in stationary applications.

Figure 2:
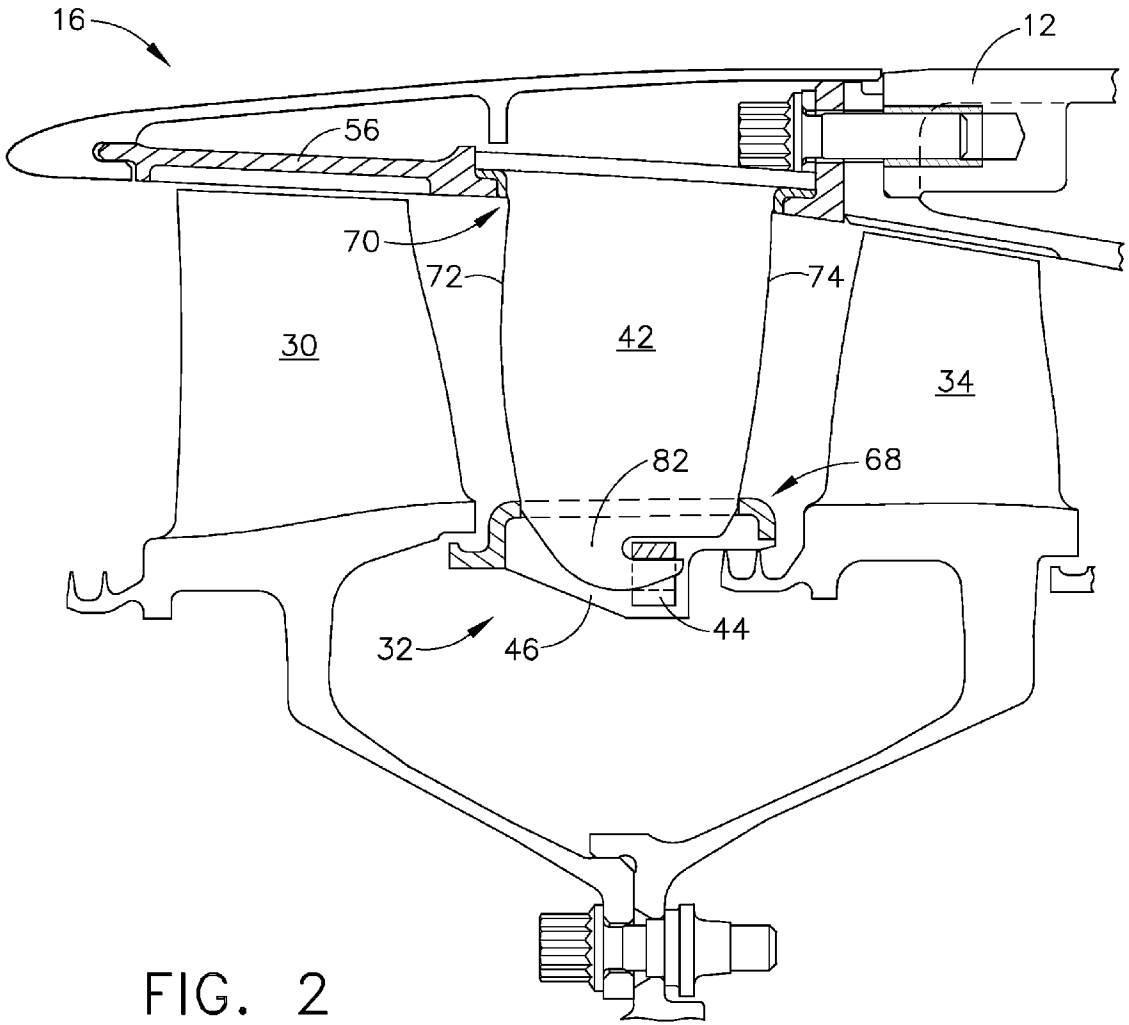
FIG. 2 is an enlarged view of a booster of the gas turbine engine of FIG. 1.
Figure 3:
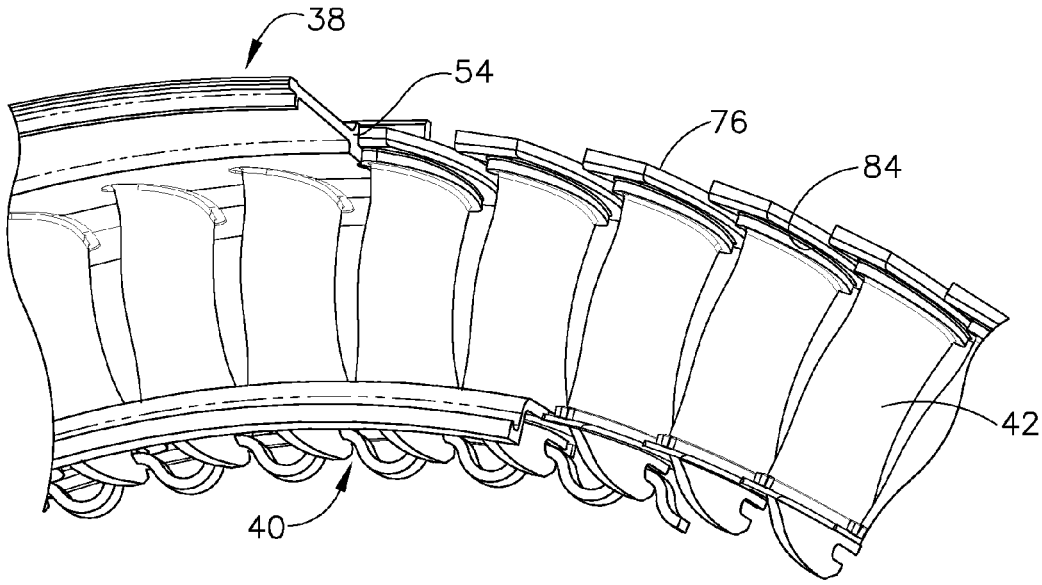
FIG. 3 is a perspective view of a stator assembly in a partially-assembled condition.
Figure 4:
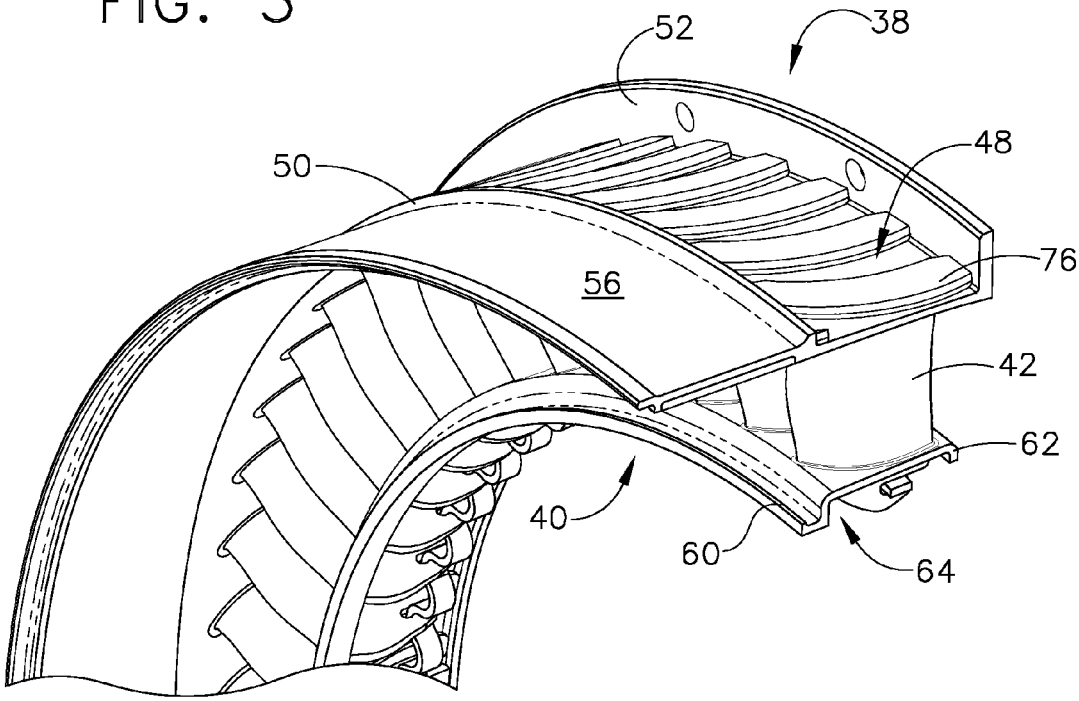
FIG. 4 is another perspective view of the stator assembly shown in FIG. 3.
Figure 5:
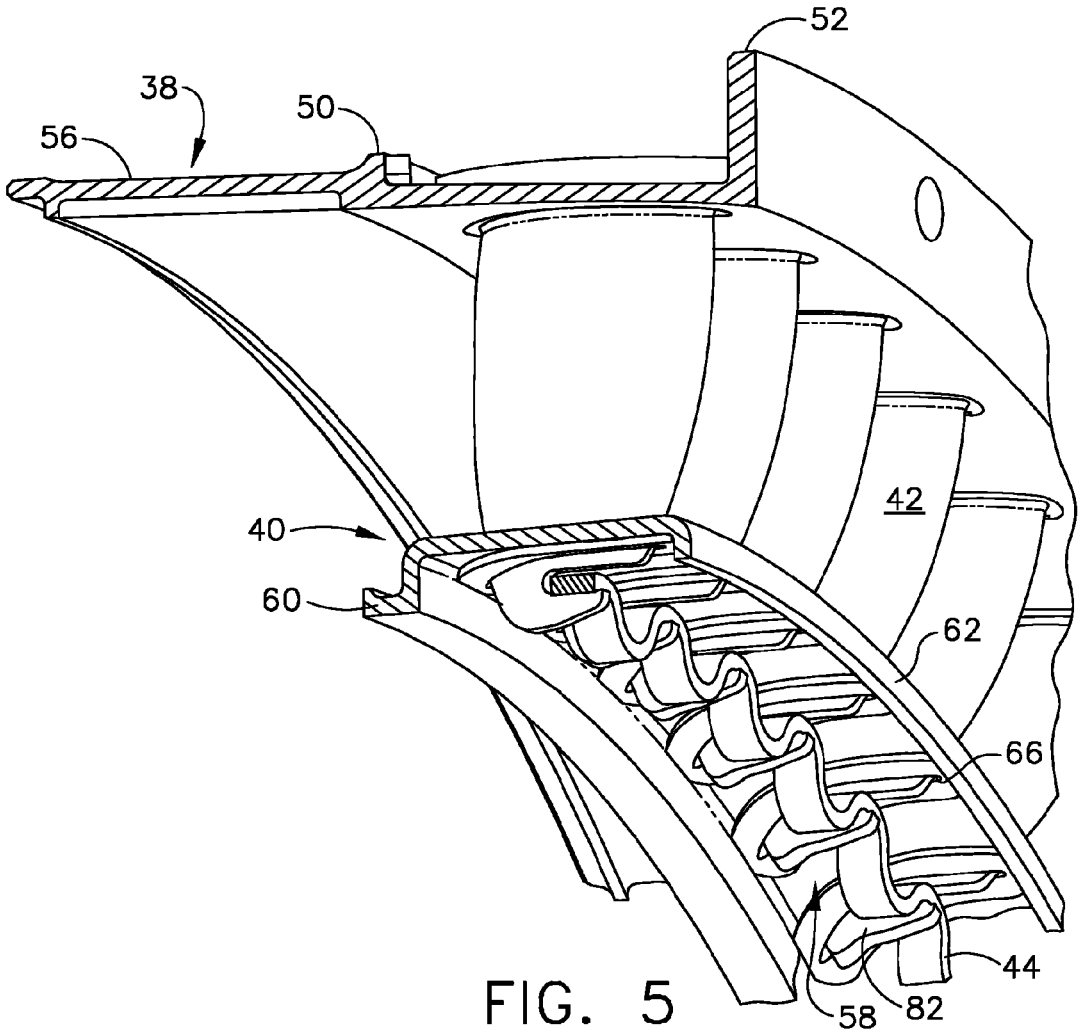
FIG. 5 is yet another perspective view of the stator assembly of FIG. 3.
Figure 6:
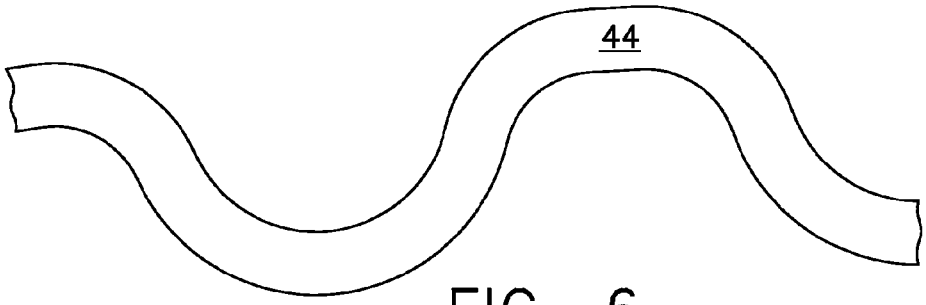
FIG. 6 is a front elevational view of a portion of a retention ring of the stator assembly.

As shown in FIG. 2, the booster 16 comprises, in axial flow sequence, a first stage 30 of rotating booster blades, a first stage stator assembly 32, a second stage 34 of rotating booster blades, and a second stage stator assembly 36 (see FIG. 1). For purposes of explanation the invention will be described using the first stage stator assembly 32 as an example, however it will be understood that the principles thereof are equally applicable to the second stage stator assembly 36, or any other similar structure.

FIGS. 3-6 illustrate the stator assembly 32 in more detail. The stator assembly generally comprises an annular outer shroud 38, an inner shroud 40, a plurality of vanes 42, a retention ring 44, and a filler block 46.

The outer shroud 38 is a rigid metallic member and has an outer face 48 which is bounded by spaced-apart, radially-outwardly-extending forward and aft flanges 50 and 52. One or both of these flanges 50 and 52 include bolt holes or other features for mechanical attachment to the casing 12. A circumferential array of airfoil-shaped outer slots 54 which are sized to receive the vanes 42 pass through the outer shroud 38. in the particular example shown, the outer shroud 38 includes a forward overhang 56 which serves as a shroud for the first stage 30 of booster blades.

The inner shroud 40 is a rigid member which may be formed from, e.g., metal or plastic, and has an inner face 58 which is bounded by spaced-apart, radially-inwardly-extending forward and aft flanges 60 and 62. Cooperatively, the forward and aft flanges 60 and 62 and the inner face 58 define an annular inner cavity 64. A circumferential array of airfoil-shaped inner slots 66 which are sized to receive the vanes 42 pass through the inner shroud 40.

Each of the vanes 42 is airfoil-shaped and has inner and outer ends 68 and 70, a leading edge 72, and a trailing edge 74. An overhanging platform 76 (see FIG. 7) is disposed at the outer end 70. It includes generally planar forward and aft faces 78 and 80. The total axial length between the forward and aft faces 78 and 80 is selected to provide a snug fit between the forward and aft flanges 50 and 52 of the outer shroud 38. The vanes 42 are received in the inner and outer slots 66 and 54. Each of the vanes 42 incorporates a hook 82 at its inner end 68. In the illustrated example the hook 82 is oriented so as to define a generally axially-aligned slot.

An axially-elongated outer grommet 84 is disposed between the platform 76 and the outer shroud 38. It has a central, generally airfoil-shaped opening which receives the outer end 70 of the vane 42. The outer grommet 84 is manufactured from a dense, resilient material which will hold the vane 42 and outer shroud 38 in a desired relative position while providing vibration dampening. Nonlimiting examples of suitable materials include fluorocarbon or fluorosilicone elastomers. Optionally, an inner grommet (not shown) of construction similar to the outer grommet 84 may be installed between the inner end 68 of the vane 42 and the inner shroud 40.

The retention ring 44 is a generally annular resilient member which engages the hooks 82 and preloads them in a radially-inward direction. The retention ring 44 may be constructed of spring steel, high strength alloys (e.g. nickel-based alloys such as INCONEL), or a similar material. The retention ring 44 incorporates features to ensure secure connection to the hooks 82. In the illustrated example the retention ring 44 has a "wave" or "corrugated" form and generally describes a flattened sinusoidal shape in a plane perpendicular to the axis A (see FIG. 6).

The filler block 46 (see FIG. 1) is a resilient member which encapsulates the hooks 82 and retention ring 44, and fills the inner cavity 64. The cross-sectional shape of the radially-inwardly-facing exposed portion is not critical. Optionally it may be used as the stationary portion of a labyrinth seal, in which case the cross-sectional shape would be complementary to that of the opposite seal component. Like the outer and inner grommets, it is manufactured from a dense, resilient material which will hold the adjacent components in a desired relative position while providing vibration dampening. An example of a suitable material is silicone rubber. The filler block 46 may optionally include a filler material, such as hollow beads, to reduce its effective weight and/or provide an abrasive effect.

Figure 7:
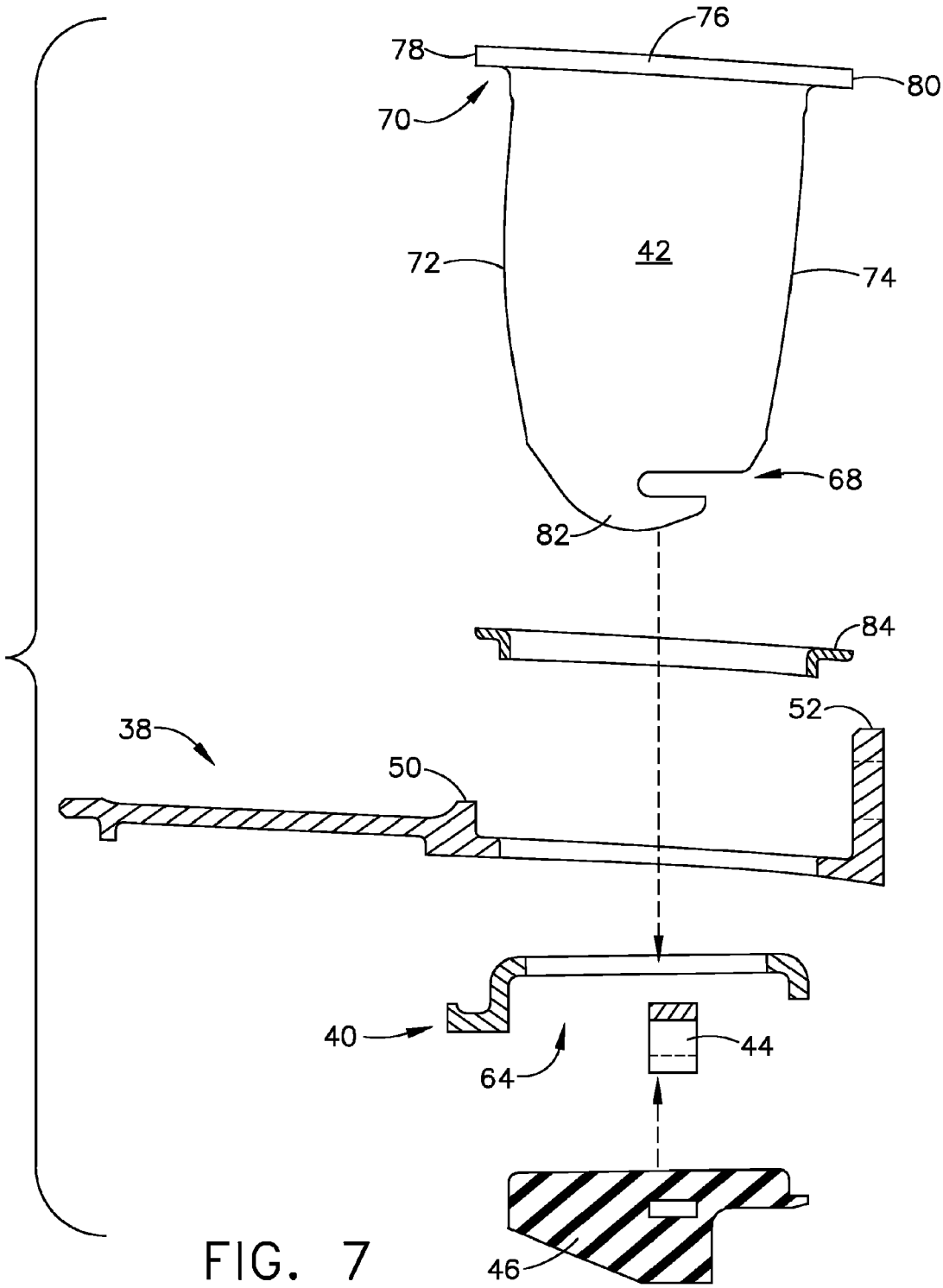
FIG. 7 is an exploded side view of the stator assembly.

The stator assembly 32 is assembled as follows, with reference to FIG. 7. First, the vanes 42 are inserted through the outer slots 54 in the outer shroud 38, and the outer grommets 84 so that the platform 76 of each vane 42 seats against the outer face 48 of the outer shroud 38, and the forward and aft faces 78 and 80 of the platform 76 bear against the forward and aft flanges 50 and 52, respectively. The inner ends of the vanes 42 pass through the respective inner slots 66 in the inner shroud 40, and through the optional inner grommet, if used (not shown). Once all the vanes 42 are installed, the retention ring 44 is engaged with the hooks 82 of each of the vanes 42 and then released to provide a radially-inwardly directed preload which retains the vanes 42 in the inner and outer shrouds 40 and 38. The filler block 46 is then formed in place in the inner cavity 64, surrounding the retention ring 44 and hooks 82 and bonding thereto. This filler block 46 may be installed, for example, by free-form application of uncured material (e.g. silicone rubber) followed by a known curing process (e.g. heating), or by providing a mold member (not shown) which surrounds the inner shroud 40 and injecting material therein. Once assembled, orientation of the vanes 42 is established by the forward and aft faces 78 and 80 of the platform 76 seating between the forward and aft flanges 50 and 52 of the outer shroud 38.

In the event disassembly or repair is required, all or part of the filler block 46 is removed, for example by being cut, ground, or chemically dissolved. The retention ring 44 may then be disengaged from one or more of the vanes 42 and any vane 42 that requires service or replacement may be removed. Alternatively the retention ring 44 may be cut to disengage it. Any or all of the filler block 46, the inner shroud 40, the outer grommets 84 and the inner grommets (if used) may be considered expendable for repair purposes. Upon reinstallation the inner shroud 40 and/or grommets would be replaced (if necessary) and the a new filler block 46 (or portions thereof) would be re-formed as described above for initial installation. The re-use of the vanes 42 and the outer ring 38 provides for an economically viable repair.

The stator assembly described above has multiple advantages over prior art designs. It is weight effective because of the use of separate airfoils and fabrication with non-metallic components. Efficient outer flowpath sealing is provided by the retention ring radial preload force. It provides easy and flexible assembly repair or airfoil replacement compared with machined, welded, or brazed configurations. It has rigidity advantages over prior art fabricated small scale stator assemblies. It provided reduced vane static stresses, offering flexibility to employ different vane airfoil material choices without compromising the assembly concept Finally, increased assembly vibration damping is provided through the use of non-metallic grommets and the resilient filler block 46.

The foregoing has described a stator assembly for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A stator assembly for a gas turbine engine, comprising:

(a) an outer shroud having a circumferential array of outer slots;

(b) an inner shroud having a circumferential array of inner slots;

(c) a plurality of airfoil-shaped vanes extending between the inner and outer shrouds, each vane having inner and outer ends which are received in the inner and outer slots, respectively, wherein each of the vanes has an overhanging platform disposed at its outer end, which is substantially larger in cross-sectional area than the corresponding outer slot; and (d) an annular, resilient retention ring spring which engages the inner ends of the vanes and urges them in a radially inward direction.

2. The stator assembly of claim 1 wherein the retention ring has a generally flatted sinusoidal shape in a plane perpendicular to a central axis of the stator assembly.

3. A stator assembly for a gas turbine engine, comprising:

(a) an outer shroud having a circumferential array of outer slots;

(b) an inner shroud having a circumferential array of inner slots;

(c) a plurality of airfoil-shaped vanes extending between the inner and outer shrouds, each vane having inner and outer ends which are received in the inner and outer slots, respectively; and (d) a resilient, non-metallic grommet disposed between the outer end of each of the vanes and the respective outer slot; and (e) an annular, resilient retention ring spring which engages the inner ends of the vanes and urges them in a radially inward direction.

4. The stator assembly of claim 3 wherein the grommet comprises fluorocarbon or fluorosilicone elastomer.

5. A stator assembly for a gas turbine engine, comprising:

(a) an outer shroud having a circumferential array of outer slots;

(b) an inner shroud having a circumferential array of inner slots;

(c) a plurality of airfoil-shaped vanes extending between the inner and outer shrouds, each vane having inner and outer ends which are received in the inner and outer slots, respectively, wherein each vane includes a hook disposed at its inner end which engages the retention ring; and (d) an annular, resilient retention ring spring which engages the inner ends of the vanes and urges them in a radially inward direction.

6. The stator assembly of claim 5 further including an annular, resilient, non-metallic filler block disposed in a inner cavity of the inner shroud, such that it encapsulates the hooks and the retention ring.

7. The stator assembly of claim 6 wherein the filler block comprises fluorocarbon or fluorosilicone elastomer.

8. A stator assembly for a gas turbine engine, comprising:

(a) an outer shroud having a circumferential array of outer slots;

(b) an inner shroud having a circumferential array of inner slots;

(c) a plurality of airfoil-shaped vanes extending between the inner and outer shrouds, each vane having inner and outer ends which are received in the inner and outer slots, respectively, wherein the retention ring has a corrugated shape.

9. A method of assembling a stator assembly for a gas turbine engine, comprising:

(a) providing an outer shroud having a circumferential array of outer slots;

(b) providing an inner shroud having a circumferential array of inner slots;

(c) inserting a plurality of airfoil-shaped vanes through the inner and outer slots;

(d) inserting a resilient, non-metallic grommet between the outer end of each of the vanes and the respective outer slot; and (e) engaging the inner ends of the vanes with a resilient retention ring which urges them in a radially inward direction.

10. The method of claim 9 wherein each of the vanes has an overhanging platform disposed at its outer end, which is substantially larger in cross-sectional area than the corresponding outer slot.

11. The method of claim 10 wherein the grommet comprises silicone rubber.

12. The method of claim 9 wherein the retention ring has a corrugated shape.

13. The method of claim 9 wherein the retention ring has a generally flatted sinusoidal shape in a plane perpendicular to a central axis of the stator assembly.

14. A method of assembling a stator assembly for a gas turbine engine, comprising:

(a) providing an outer shroud having a circumferential array of outer slots;

(b) providing an inner shroud having a circumferential array of inner slots;

(c) inserting a plurality of airfoil-shaped vanes through the inner and outer slots; and (d) engaging a hook disposed at the inner end of each vane with a resilient retention ring retention ring which urges them in a radially inward direction.

15. The method of claim 14 further comprising installing an annular, resilient, non-metallic filler block in a inner cavity of the inner shroud, such that it encapsulates the hooks and the retention ring.

16. The method of claim 15 wherein the filler block is installed by: (a) applying an uncured material in flowable form to the inner cavity; and (b) curing the material so as to solidify it.

17. The method of claim 15 wherein the filler block comprises fluorocarbon or fluorosilicone elastomer.

* * * * *